US011705273B2

(12) United States Patent
Kobayashi et al.

(10) Patent No.: US 11,705,273 B2
(45) Date of Patent: Jul. 18, 2023

(54) COIL COMPONENT

(71) Applicant: Murata Manufacturing Co., Ltd., Kyoto-fu (JP)

(72) Inventors: Kohei Kobayashi, Nagaokakyo (JP); Shizuka Moriya, Nagaokakyo (JP); Yuki Nakamura, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 776 days.

(21) Appl. No.: 16/575,071

(22) Filed: Sep. 18, 2019

(65) Prior Publication Data

US 2020/0105464 A1 Apr. 2, 2020

(30) Foreign Application Priority Data

Sep. 28, 2018 (JP) ..... 2018-185165

(51) Int. Cl.
*H01F 27/28* (2006.01)
*H01F 27/34* (2006.01)
*H01F 27/24* (2006.01)

(52) U.S. Cl.
CPC ..... *H01F 27/341* (2013.01); *H01F 27/24* (2013.01); *H01F 27/2823* (2013.01)

(58) Field of Classification Search
CPC .... H01F 27/341; H01F 27/24; H01F 27/2823; H01F 17/045; H01F 17/06; H01F 17/033; H01F 2017/0026; H01F 27/29; H01F 2017/0093; H01F 17/04; H01F 27/306
See application file for complete search history.

(56) References Cited

U.S. PATENT DOCUMENTS

2009/0295525 A1* 12/2009 Okawa ..... H01F 27/006 336/192
2017/0221626 A1* 8/2017 Tomonari ..... H01F 17/045
2017/0288626 A1* 10/2017 Kobayashi ..... H03H 1/00
2018/0211763 A1* 7/2018 Komaya ..... H01F 27/2828
2018/0301275 A1* 10/2018 Tomonari ..... H01F 27/28

FOREIGN PATENT DOCUMENTS

JP 2014-120730 A 6/2014
JP 2015-35473 A 2/2015
JP 2017-183444 A 10/2017

OTHER PUBLICATIONS

An Office Action; "Notice of Reasons for Refusal," mailed by the Japanese Patent Office dated Mar. 2, 2021, which corresponds to Japanese Patent Application No. 2018-185165 and is related to U.S. Appl. No. 16/575,071 with English language translation.

* cited by examiner

*Primary Examiner* — Mang Tin Bik Lian
(74) *Attorney, Agent, or Firm* — Studebaker & Brackett PC

(57) ABSTRACT

A coil component includes a core that includes a core part having a first end portion and a second end portion; and a first wire and a second wire that are wound around the core part from the first end portion to the second end portion in substantially helical shapes so as to have substantially the same number of turns. The first wire is wound so as to form a first layer that contacts the peripheral surface of the core part, the second wire is wound such that at least part of the second wire forms a second layer on the outside of the first layer, and a first coil length formed by the first wire is longer than a second coil length formed by the second wire.

21 Claims, 8 Drawing Sheets

COIL COMPONENT

CROSS-REFERENCE TO RELATED APPLICATION

This application claims benefit of priority to Japanese Patent Application No. 2018-185165, filed Sep. 28, 2018, the entire content of which is incorporated herein by reference.

BACKGROUND

Technical Field

The present disclosure relates to a coil component.

Background Art

A winding-type common-mode choke coil is an example of a coil component of the related art. A winding-type common-mode choke coil includes a core part and two wires that are wound around the core part as described, for example, in Japanese Unexamined Patent Application Publication No. 2015-35473.

The above-described common-mode choke coil is, for example, used to remove common-mode noise superimposed on a signal line. Therefore, improvement of characteristics is demanded in accordance with the intended use of the common-mode choke coil. For example, with respect to radio-frequency characteristics, various countermeasures such as suppressing parasitic capacitance components have been investigated. In recent years, for example, a coil component is sometimes used in a low-frequency band. The characteristics of a coil component in such a frequency band cannot be improved by just further developing techniques such as suppressing parasitic capacitance components as in the above-mentioned investigations.

SUMMARY

A coil component according to a preferred embodiment of the present disclosure includes a core including a core part having a first end portion and a second end portion; and a first wire and a second wire that are wound around the core part from the first end portion to the second end portion in substantially helical shapes so as to have substantially identical numbers of turns. The first wire is wound so as to form a first layer that contacts a peripheral surface of the core part. The second wire is wound such that at least part of the second wire forms a second layer on the outside of the first layer. A first coil length formed by the first wire is longer than a second coil length formed by the second wire.

With this configuration, the difference between the inductance value of the coil formed by the first wire constituting the first layer that contacts the peripheral surface of the core part and the inductance value of the coil formed by the second wire, at least part of which constitutes the second layer on the outside of the first wire, can be made small and a characteristic can be improved.

With the coil component according to the preferred embodiment of the present disclosure, a coil component can be provided that can improve a characteristic of the coil component.

Other features, elements, characteristics and advantages of the present disclosure will become more apparent from the following detailed description of preferred embodiments of the present disclosure with reference to the attached drawings.

DETAILED DESCRIPTION

Preliminary Matters

Figure 1:
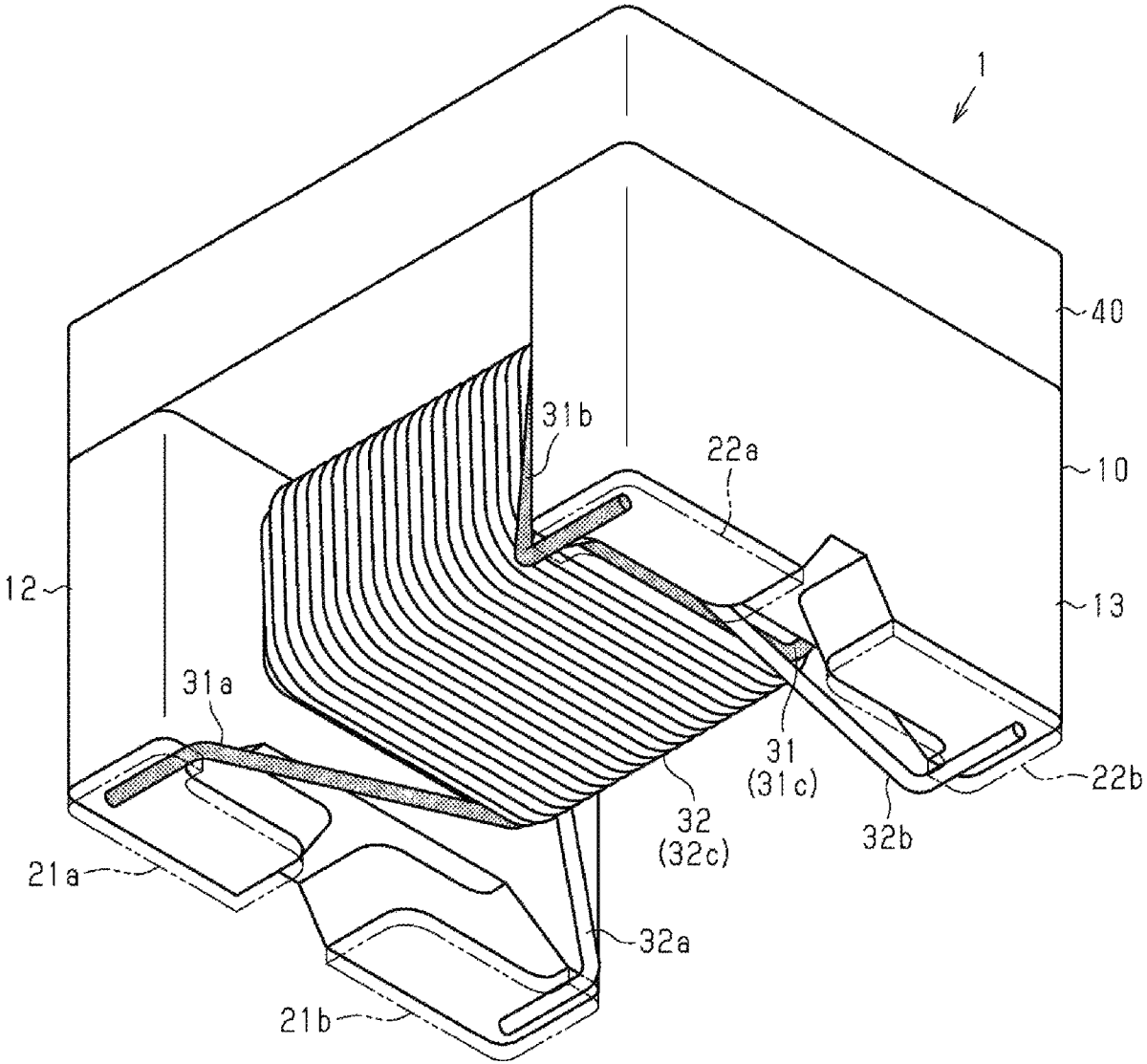
FIG. 1 is a schematic perspective view of a coil component of an embodiment of the present disclosure.

First, before describing an embodiment, fundamental preliminary matters will be described.

A common-mode choke coil is a representative example of a coil component. A common-mode choke coil includes a core and a first wire and a second wire that are wound around the core and form coils. The core is for example formed of an electrically insulating material, and specifically consists of a non-magnetic body composed of alumina or a resin or a magnetic body composed of ferrite or a magnetic-powder-containing resin. The first wire and the second wire are composed of insulated copper wire, for example. The first wire is wound so as to form a first layer that contacts the peripheral surface of a core part of the core, and the second wire is wound so as to form a second layer on the outside of the first layer.

Generally, an inductance value L of a coil is given by the following formula. Here, μ is the magnetic permeability, k is the Nagaoka coefficient, S is the cross-sectional area of the coil, l is the length of the coil, and N is the number of turns of the coil (turn number).

$$L = \frac{k\mu SN^2}{l} \quad \text{Math 1}$$

Thus, the inductance value L of the coil is increased by increasing the inner diameter of the coil or decreasing the length of the coil.

In a common-mode choke coil, improvement of a scattering (S) parameter such as Sds21, which is a mode conversion characteristic, is demanded. In the past, improvement of Sds21 in a high-frequency region has been demanded, whereas improvement of Sds21 in a low-frequency region has been newly demanded recently. It is known that reducing parasitic capacitances between wires greatly contributes to improvement of Sds21 in a high-frequency region. On the other hand, it is known from experiments that a difference in inductance value between wound coils contributes more greatly to improvement of Sds21 than parasitic capacitances between wires.

For inductance values obtained using the above formula, the inductance value of the coil formed by the second wire wound around the outside of the first wire is larger than the inductance value of the coil formed by the first wire wound so as to contact the peripheral surface of the core part. However, the inventors of the present case found that the inductance value of the first wire is actually larger than the inductance value of the second wire. This is thought to be because the distance between the core part and the second wire is larger than the distance between the core part and the first wire, and therefore the magnetic permeability of the core part is in effect reduced.

Focusing on the above-described finding that the inductance value of the coil formed by the second wire wound around the outside of the first wire is larger than the inductance value of the coil formed by the first wire wound so as to contact the peripheral surface of the core part led the inventors of the present case to conceive of the embodiment described below.

Embodiment

Hereafter, an embodiment of the present disclosure will be described. In the accompanying drawings, constituent elements may be illustrated in an enlarged manner for ease of understanding. Dimensional ratios of the constituent elements may differ from the actual ratios or may differ from the ratios in other drawings. Furthermore, in the sectional views, the hatching of some constituent elements may be omitted for ease of understanding.

Figure 2:
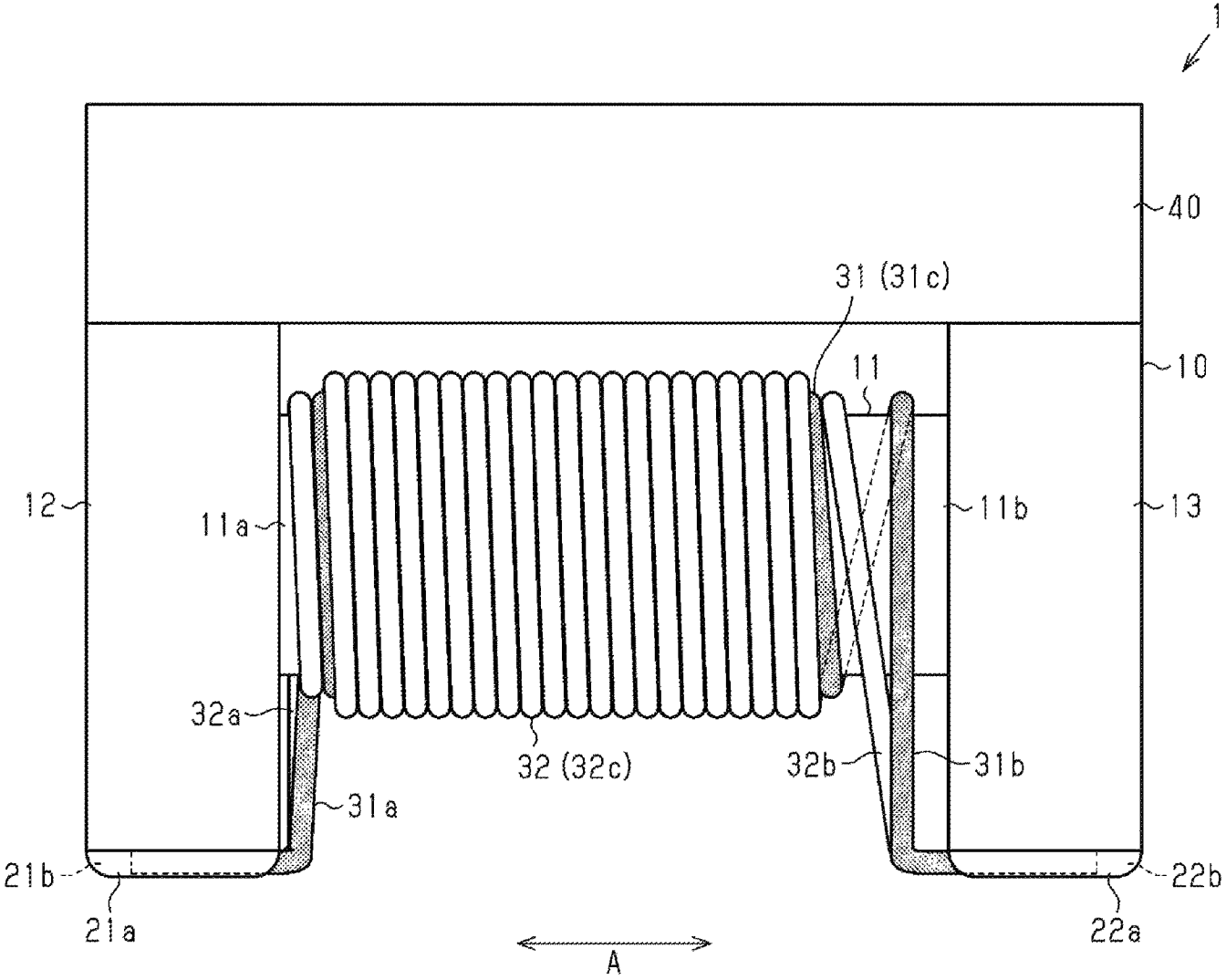
FIG. 2 is a schematic side view of the coil component of the embodiment.
Figure 3:
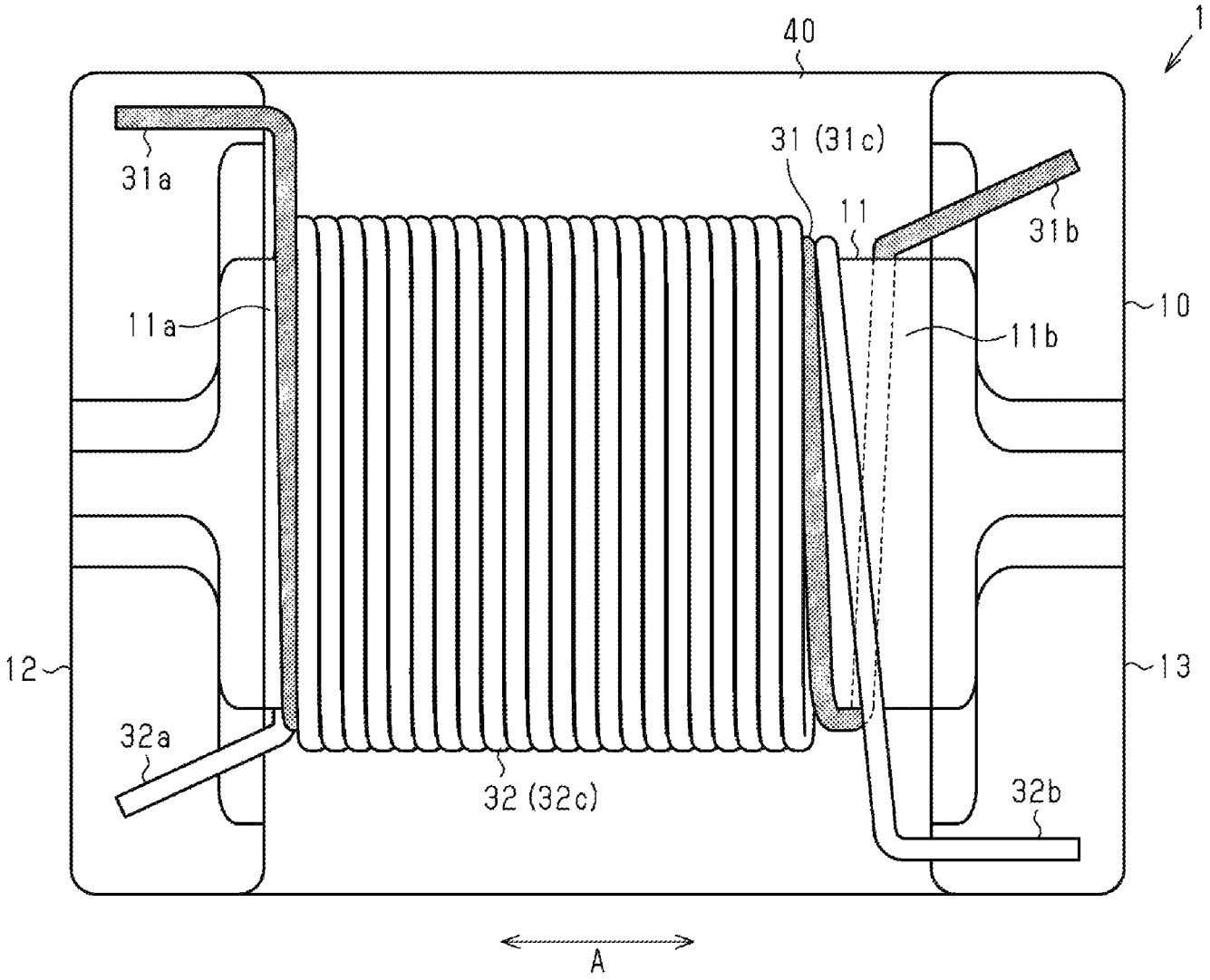
FIG. 3 is a schematic bottom view of the coil component of the embodiment.

FIG. 1 is a perspective view of a coil component 1 of an embodiment, FIG. 2 is a side view of the coil component 1, and FIG. 3 is a bottom view of the coil component 1.

As illustrated in FIGS. 1, 2, and 3, the coil component 1 includes a core 10, wires 31 and 32, and a top plate 40. The coil component 1 is a common mode choke coil, for example.

The core 10 is for example formed of an electrically insulating material, and specifically consists of a non-magnetic body composed of alumina or a resin or a magnetic body composed of ferrite or a magnetic-powder-containing resin. The core 10 is preferably composed of a sintered body composed of alumina or ferrite, for example.

The core 10 includes a substantially square-column-shaped core part 11 that extends in an axial direction (direction indicated by arrow A in FIGS. 2 and 3); a first flange part 12 that is provided at a first end portion 11*a* of the core part 11 in the axial direction; and a second flange part 13 that is provided at a second end portion 11*b* of the core part 11 in the axial direction. The first flange part 12 and the second flange part 13 each have a substantially rectangular plate-like shape. The core part 11, the first flange part 12, and the second flange part 13 are formed so as to be integrated with each other.

As illustrated in FIG. 1, the first flange part 12 has first terminal electrodes 21*a* and 21*b* on a bottom part thereof and the second flange part 13 has second terminal electrodes 22*a* and 22*b* on a bottom part thereof. The terminal electrodes are represented by broken lines in FIG. 1 and are omitted from FIG. 3. The first terminal electrodes 21*a* and 21*b* and the second terminal electrodes 22*a* and 22*b* each include a metal layer and a plating layer on the surface of the metal layer, for example. For example, a metal such as silver (Ag) or copper (Cu) or an alloy such as nickel (Ni)-chromium (Cr) or Ni—Cu may be used as the material of the metal layer. Metals such as tin (Sn) and Ni or an alloy such as Ni—Sn may be used as the material of the plating layer. In addition, the plating layer may have a multilayer structure.

A first wire 31 and a second wire 32 are wound around the core part 11 in the same direction in substantially helical shapes so as to have the substantially the same number of turns. In addition, the first wire 31 and the second wire 32 are wound around the peripheral surface of the core part 11 in layers. Manufacturing efficiency can be increased by simultaneously winding the first wire 31 and the second wire 32 around the core part 11 using bifilar winding.

Figure 4A:
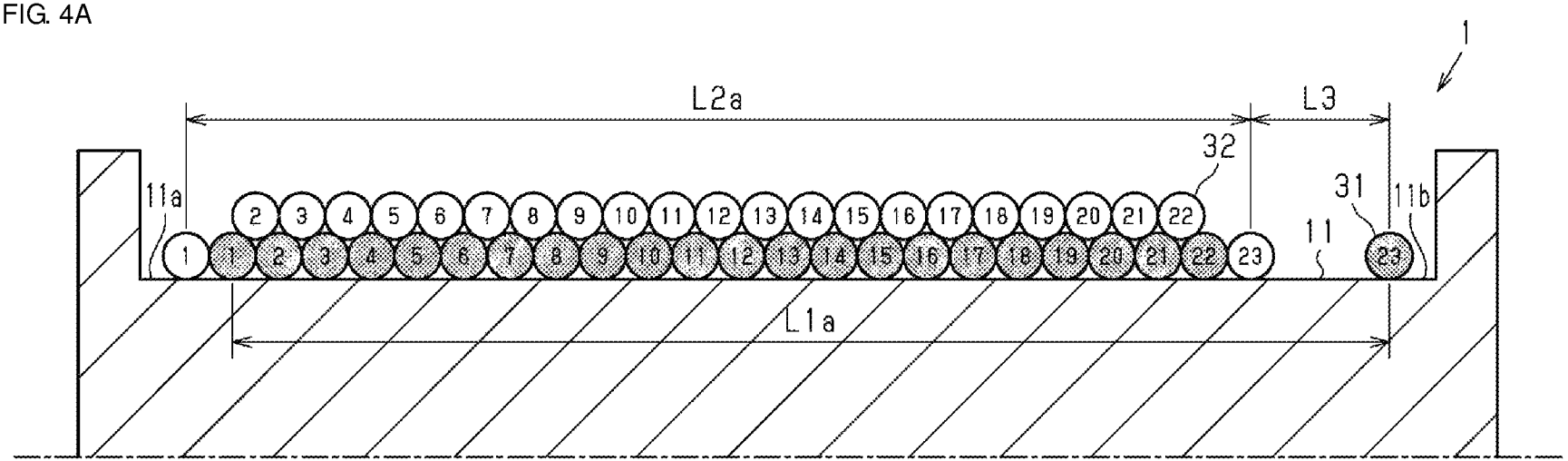
FIG. 4A is an explanatory diagram illustrating windings of the coil component of the embodiment and FIG. 4B is an explanatory diagram illustrating windings of a coil component of a comparative example.

As illustrated in FIG. 4A, the first wire 31 is wound from the first end portion 11*a* to the second end portion 11*b* of the core part 11 so as to form a first layer that contacts the peripheral surface of the core part 11. The second wire 32 is wound such that part of the second wire 32 forms a second layer on the outside of the first layer.

As illustrated in FIG. 1, a first end portion 31*a* of the first wire 31 is connected to the first terminal electrode 21*a* of the first flange part 12 and a second end portion 31*b* of the first wire 31 is connected to the second terminal electrode 22*a* of the second flange part 13. A first end portion 32*a* of the second wire 32 is connected to the first terminal electrode 21*b* of the first flange part 12 and a second end portion 32*b* of the second wire 32 is connected to the second terminal electrode 22*b* of the second flange part 13. That is, the first wire 31 and the second wire 32 are wound in substantially helical shapes in two layers around the core part 11. In the accompanying drawings, the first wire 31 is shaded with hatching to allow the first wire 31 and the second wire 32 to be clearly distinguished from each other.

The first wire 31 and the second wire 32, for example, each include a core wire having a substantially circular cross section and a covering material that covers the surface of the core wire. For example, a conductive material such as Cu or Ag can be used as the main constituent of the material of the core wire. An insulating material such as polyurethane or polyimide can be used as the material constituting the covering material. The diameters of the first wire 31 and the second wire 32 are 30 to 50 μm, for example. For example, thermal pressure bonding or laser welding is used to form the connections between the first terminal electrodes 21*a* and 21*b* and the second terminal electrodes 22*a* and 22*b*, and the first wire 31 and the second wire 32.

The top plate 40 is a plate-shaped member having a substantially rectangular shape when viewed from above (upper side in FIG. 2). The top plate 40 is bonded to the top surfaces of the first flange part 12 and the second flange part 13 of the core 10 using an adhesive. The top surfaces of the first flange part 12 and the second flange part 13 are the surfaces on the opposite side from the side on which the first terminal electrodes 21*a* and 21*b* and the second terminal electrodes 22*a* and 22*b* are formed.

The top plate 40 is for example formed of an electrically insulating material, and specifically consists of a non-magnetic body composed of alumina or a resin or a magnetic body composed of ferrite or a magnetic-powder-containing resin. The top plate 40 is preferably composed of a sintered body composed of alumina or ferrite, for example. For example, if the top plate 40 is formed of the same magnetic material as the core 10, a stable closed magnetic circuit can be formed, which is preferable. In addition, the top plate 40 can be made thin by forming the top plate 40 using a resin, for example.

As illustrated in FIGS. 2 and 3, the first wire 31 includes a wound part 31*c*, which is the part of the first wire 31 that is wound around the core part 11, and the first end portion 31*a* and the second end portion 31*b* disposed at both sides of the wound part 31*c*. The second wire 32 includes a wound part 32*c*, which is the part of the second wire 32 that is wound around the core part 11, and the first end portion 32*a* and the second end portion 32*b* disposed at both sides of the wound part 32*c*.

Next, the wound state of the first wire 31 and the second wire 32 will be described.

Figure 4B:
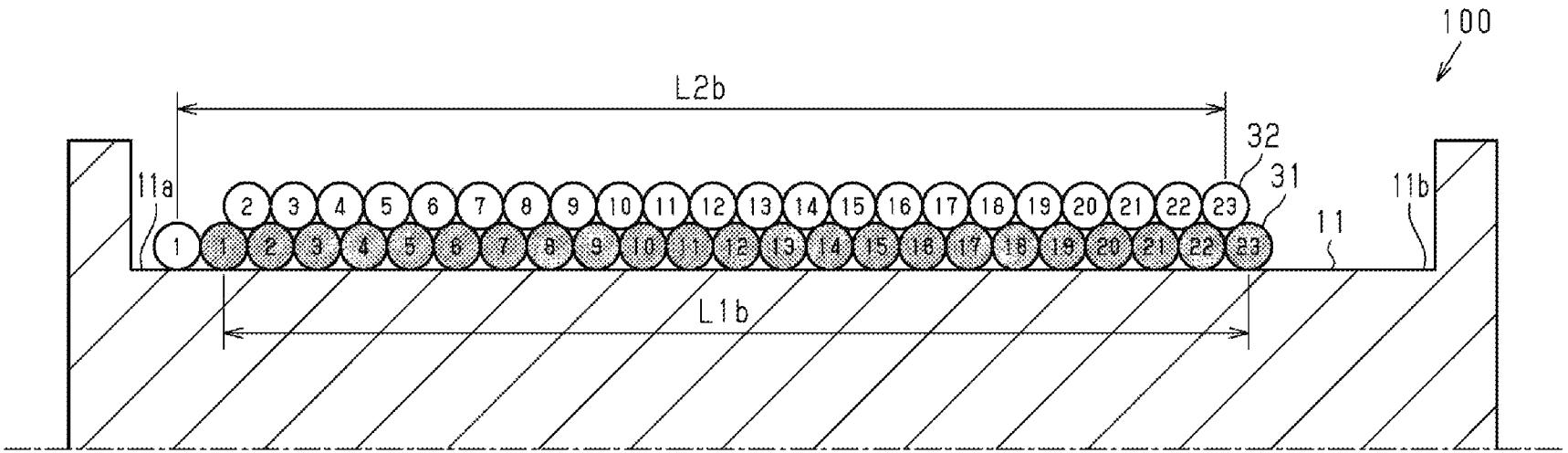

FIG. 4A illustrates the wound state in this embodiment and FIG. 4B illustrates the wound state in a comparative example. In FIGS. 4A and 4B, numerical characters inside the wires 31 and 32 represent the turn numbers of the wires 31 and 32. FIG. 4A illustrates a cross section taken along the axial direction in a place where a gap between a twenty-second turn and a twenty-third turn of the first wire 31 is maximum.

As illustrated in FIG. 4A, the first wire 31 is wound from the first end portion 11*a* to the second end portion 11*b* of the core part 11 so as to form the first layer that contacts the peripheral surface of the core part 11. In addition, the final turn of the first wire 31 is wound such that a gap is formed between the final turn and the turn adjacent thereto. In more detail, the first wire 31 is wound from the first end portion 11*a* to the second end portion 11*b* of the core part 11 such that a gap is not formed between adjacent turns until one turn before the final turn, i.e., from the first turn until the twenty-second turn. The meaning of "such that a gap is not formed between adjacent turns" includes a case where the wire is wound such that there are parts where some adjacent turns are separated from each other and a case where the wire is wound such that there is a small gap between all adjacent turns.

The twenty-third turn, which is the final turn, of the first wire 31 is wound so as to be separated from the twenty-second turn, which is immediately previous adjacent turn, in the direction toward the second end portion 11*b* of the core part 11 and such that a gap is formed between the twenty-third turn and the twenty-second turn. In this embodiment, the twenty-third turn is wound so as to gradually become separated, in the direction toward the second end portion 11*b* of the core part 11, from the immediately previous adjacent twenty-second turn and such that a gap is formed between the twenty-second turn and the twenty-third turn. In FIGS. 2 and 3, the part of the first wire 31 that is wound so as to be separated is illustrated with a broken line. The gap is largest in the part where the first wire 31 is separated from the core.

The second wire 32 is simultaneously wound with the first wire 31 from the first end portion 11*a* to the second end portion 11*b* of the core part 11 so as to form the second layer on the outside of the first layer. The second wire 32 is wound such that gaps are not formed between adjacent turns. In addition, the second wire 32 is wound so as to fit into recesses formed between every two adjacent turns of the first wire 31.

The first wire 31 is wound such that the final turn thereof is separated from the immediately previous turn. Therefore, the first turn, which is the first turn, of the second wire 32, and the twenty-third turn, which is the final turn, of the second wire 32 are wound so as to contact the peripheral surface of the core part 11.

In more detail, the first turn of the second wire 32 is wound so as to be adjacent to the first turn of the first wire 31 and so as to contact the peripheral surface of the core part 11. The second wire 32 is wound from the second turn to the twenty-second turn, which is the turn immediately prior to the final turn, on the outside of the first wire 31 so as to contact the first wire 31 from the second turn to the twenty-second turn of the first wire 31, which are the same turns as the second wire 32. The final twenty-third turn of the second wire 32 is wound so as to be adjacent to the twenty-second turn of the first wire 31 and so as to contact the peripheral surface of the core part 11.

In addition, as illustrated in FIG. 4A, the final turn (twenty-third turn) of the first wire 31 is wound so as to be separated from the final turn (twenty-third turn) of the second wire 32. A length L3 from the twenty-third turn of the first wire 31 to the twenty-third turn of the second wire 32 (distance between centers of wires) is 150 μm, for example. It is preferable that the twenty-second turn and the twenty-third turn be separated from each other by at least three times the diameter of the first wire 31 and it is more preferable that the twenty-second turn and the twenty-third turn be separated from each other by at least five times the diameter of the first wire 31.

A coil length L1*a* of a first coil formed by the thus-wound first wire 31 is the length from the first turn to the twenty-third turn of the first wire 31, for example, the distance from the center of the first turn to the center of the twenty-third turn. The distance between the centers of adjacent turns is the distance from the center of one turn in a cross section of the wire to the center of the adjacent turn in a cross section of the wire in a cross section taken along a direction from the first end portion 11*a* toward the second end portion 11*b* of the core part 11. Similarly, a coil length L2*a* of a second coil formed by the thus-wound second wire 32 is the length from the first turn to the twenty-third turn of the second wire 32, for example, the distance from the center of the first turn to the center of the twenty-third turn.

In a coil component 100 of a comparative example illustrated in FIG. 4B, a first wire 31 is wound from a first turn, which is the first turn, to a twenty-third turn, which is the final turn, without gaps being formed between adjacent turns. In other words, a coil length L1*b* of a first coil formed by the first wire 31 in the comparative example is the length from the first turn to the twenty-third turn of the first wire 31 (distance from center of first turn to center of twenty-third turn of the wire).

In the comparative example, the second wire 32 is wound such that the final twenty-third turn of the second wire 32 is adjacent to the final twenty-third turn of the first wire 31 and such that the twenty-third turn of the second wire 32 fits into a recess between the twenty-second turn and the twenty-third turn of the first wire 31. A coil length L2*b* of a second coil formed by the second wire 32 in the comparative example is the length from the first turn to the twenty-third turn of the second wire 32 (distance from center of first turn to center of twenty-third turn).

The coil length L1*a* of the first coil formed by the first wire 31 in the embodiment illustrated in FIG. 4A is longer than the coil length L1*b* of the first coil formed by the first wire 31 in the comparative example illustrated in FIG. 4B. Therefore, the inductance value L of the first coil formed by the first wire 31 can be made smaller than the inductance value L in the case where the first wire 31 is wound as described in the comparative example.

Thus, although the inductance value generated by the first wire 31 is larger than the inductance value generated by the second wire 32 in the comparative example, in the embodiment, the inductance value generated by the first wire 31 can be made smaller than in the comparative example. Therefore, the difference between the inductance value L of the first coil and the inductance value L of the second coil can be made small in the coil component 1. Thus, a mode conversion characteristic of the coil component 1 can be improved by making the inductance value L generated by the first wire 31 and the inductance value L generated by the second wire 32 uniform (reducing the difference therebetween).

Figure 6:
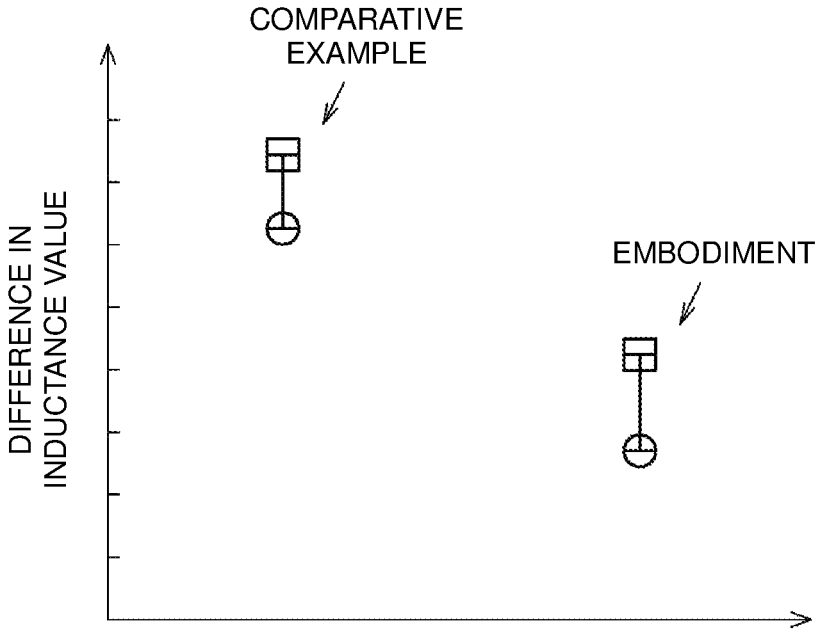
FIG. 6 is an explanatory diagram for explaining inductance values of the coil components.

FIG. 6 illustrates measurement results for the inductance values of the coil component 1 of this embodiment (FIG. 4A) and the coil component 100 of the comparative example (FIG. 4B). FIG. 6 illustrates the largest value and the smallest value of the difference between the measured inductance value L of the first wire 31 and the measured inductance value L of the second wire 32 for a plurality (for example, five) samples, where the left-hand bar represents the measurement results for the coil component 100 of the comparative example and the right-hand bar represents the measurement results for the coil component 1 of this embodiment. In each of these bars, a square represents the largest value of the difference in inductance value L and a circle represents the smallest value of the difference in inductance value L. It was confirmed that the difference in inductance value L can be reduced in the coil component 1 of this embodiment compared with coil component 100 of the comparative example. The ratio of the difference with respect to an average value La (=(L1−L2)/La×100), where La is the average value of an inductance value L1 generated by the first wire 31 and an inductance value L2 generated by the second wire 32, was 1.57-1.72% for the coil component 100 of the comparative example and 1.04-1.22% for the coil component 1 of this embodiment. The difference between the inductance value L1 generated by the first wire 31 and the inductance value L2 generated by the second wire 32 could be made less than 1.50%, and therefore Sds21 could be improved. Thus, it was confirmed that the difference in inductance value L can be reduced in the coil component 1 of this embodiment compared with coil component 100 of the comparative example.

Figure 5:
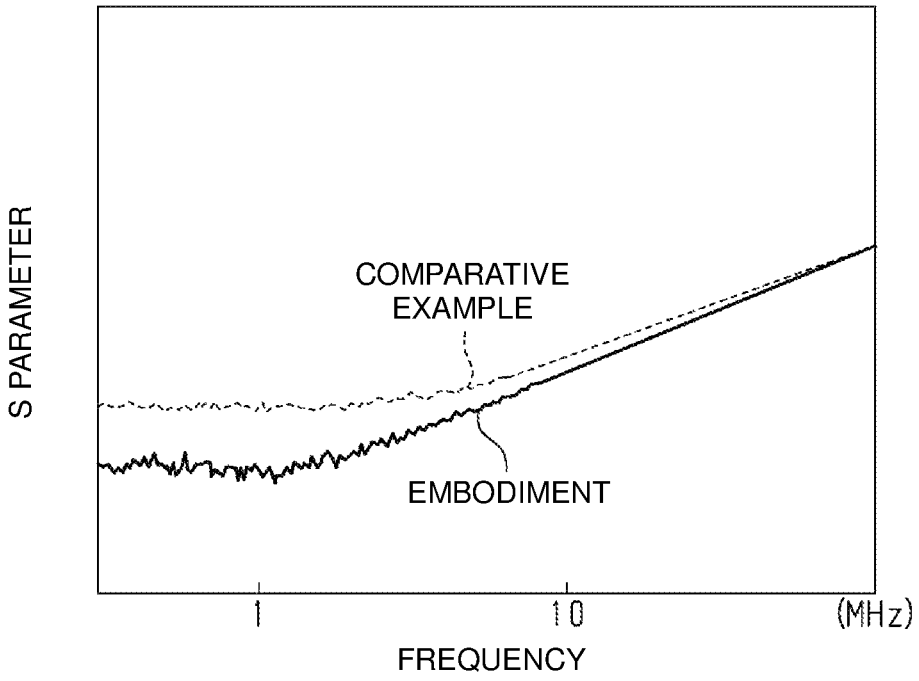
FIG. 5 is an explanatory diagram illustrating frequency characteristics of the coil components.

FIG. 5 illustrates frequency characteristics of the coil component 1 of this embodiment (FIG. 4A) and the coil component 100 of the comparative example (FIG. 4B). In FIG. 5, the horizontal axis represents frequency and the vertical axis represents an S parameter (mode conversion characteristic Sds21). In FIG. 5, the characteristic of the coil component 1 of this embodiment is represented by a solid line and the characteristic of the coil component 100 of the comparative example is represented by a broken line. Thus, compared with the coil component 100 of the comparative example, in the coil component 1 of this embodiment, an improvement in the characteristic (reduction in noise) is particularly seen in a region where the frequency is less than or equal to 1 MHz.

As described above, according to this embodiment, the following effect is realized.

(1) The coil component 1 includes: the core 10 that includes the core part 11 that has the first end portion 11*a* and the second end portion 11*b*; and the first wire 31 and the second wire 32 that are wound around the core part 11 from the first end portion 11*a* to the second end portion 11*b* in substantially helical shapes so as to have substantially the same number of turns. The first wire 31 is wound so as to form a first layer that contacts the peripheral surface of the core part, the second wire 32 is wound such that at least part of the second wire 32 forms a second layer on the outside of the first layer, and the first coil length L1*a* formed by the first wire 31 is longer than the second coil length L2*a* formed by the second wire 32.

In the case where the first wire 31 and the second wire 32 are wound so as to have the same coil length, the inductance value L of the coil formed by the first wire 31 is larger than the inductance value L of the coil formed by the second wire 32. Therefore, the difference between the inductance values L generated by the first wire 31 and the second wire 32 can be reduced by making the first coil length L1*a* realized by the first wire 31 longer than the second coil length L2*a* realized by the second wire 32 and thereby reducing the inductance value L of the coil formed by the first wire 31. Thus, the characteristic of the coil component 1 can be improved.

Modifications

The above-described embodiment may be implemented in the following ways.

The ways in which the first wire 31 and the second wire 32 are wound may be changed as appropriate.

Figure 7A:
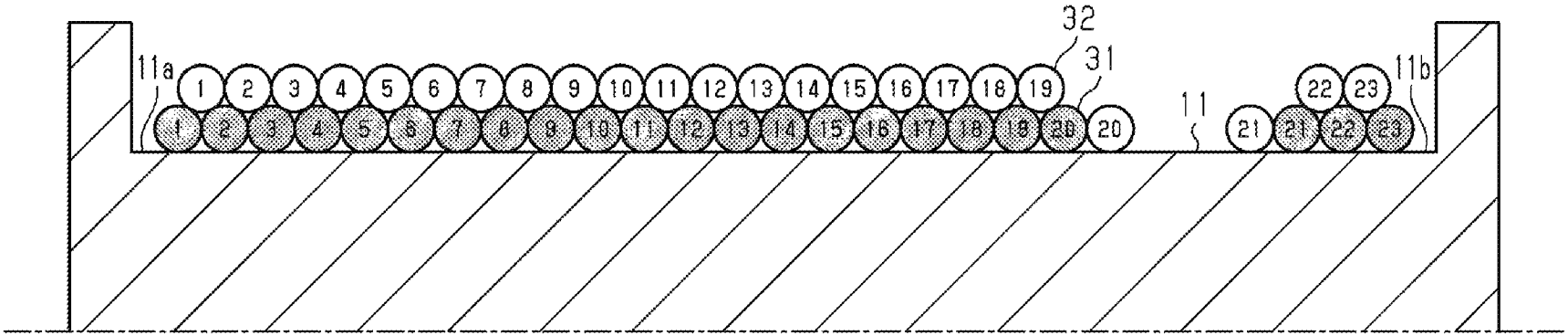
FIGS. 7A and 7B are explanatory diagrams illustrating windings of a coil component of a modification.

As illustrated in FIG. 7A, the twentieth turn and the twenty-first turn of the first wire 31, which are partway along the first wire 31, are spaced apart from each other and the second wire 32 is wound between the first turn, which is the first turn, and the twenty-third turn, which is the final turn, of the first wire 31, and therefore the coil length of the first coil formed by the first wire 31 is increased, and consequently the difference between the inductance value L of the first coil and the inductance value L of the second coil formed by the second wire 32 can be made smaller and the mode conversion characteristic can be improved.

In addition, a parasitic capacitance generated between different turns of the first wire 31 and the second wire 32 can be reduced by making the first wire 31 and the second wire 32 intersect (cross) each other between the twentieth turn and the twenty-first turn.

Figure 9:
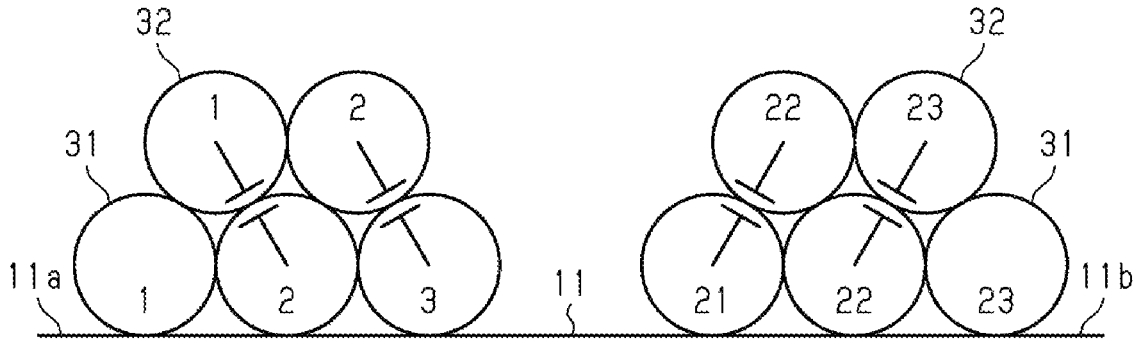
FIG. 9 is an explanatory diagram for explaining parasitic capacitances in a wound wire.

As illustrated in FIG. 9, the first turn of the second wire 32 is wound so as to fit into a recess between the first turn and the second turn of the first wire 31 and the second turn of the second wire 32 is wound so as to fit into a recess between the second turn and the 3rd turn of the first wire 31. In this case, a parasitic capacitance is generated between the second turn of the first wire 31 and the first turn of the second wire 32. Similarly, a parasitic capacitance is generated between the 3rd turn of the first wire 31 and the second turn of the second wire 32.

The twenty-second turn of the second wire 32 is wound so as to fit into a recess between the twenty-first turn and the twenty-second turn of the first wire 31 and the twenty-third turn of the second wire 32 is wound so as to fit into a recess between the twenty-second turn and the twenty-third turn of the first wire 31. Therefore, a parasitic capacitance is generated between the twenty-first turn of the first wire 31 and the twenty-second turn of the second wire 32 and a parasitic capacitance is generated between the twenty-second turn of the first wire 31 and the twenty-third turn of the second wire 32. In other words, a parasitic capacitance is generated between an nth turn of the first wire 31 and an (n−1)-th turn of the second wire 32 on the first end portion 11*a* side of the core part 11, whereas a parasitic capacitance is generated between an nth turn of the first wire 31 and an (n+1)-th turn of the second wire 32 on the second end portion 11*b* side of the core part 11. Therefore, a parasitic capacitance generated between the first wire 31 and the second wire 32 on the first end portion 11*a* side of the core part 11 and a parasitic capacitance generated between the first wire 31 and the second wire 32 on the second end portion 11*b* side of the core part 11 cancel each other out and the parasitic capacitance of the coil component as a whole can be reduced. Thus, the characteristics of the coil component can be improved by reducing parasitic capacitances that greatly affect a high-frequency region in addition to the difference in inductance value that greatly affects a low-frequency region.

Figure 7B:
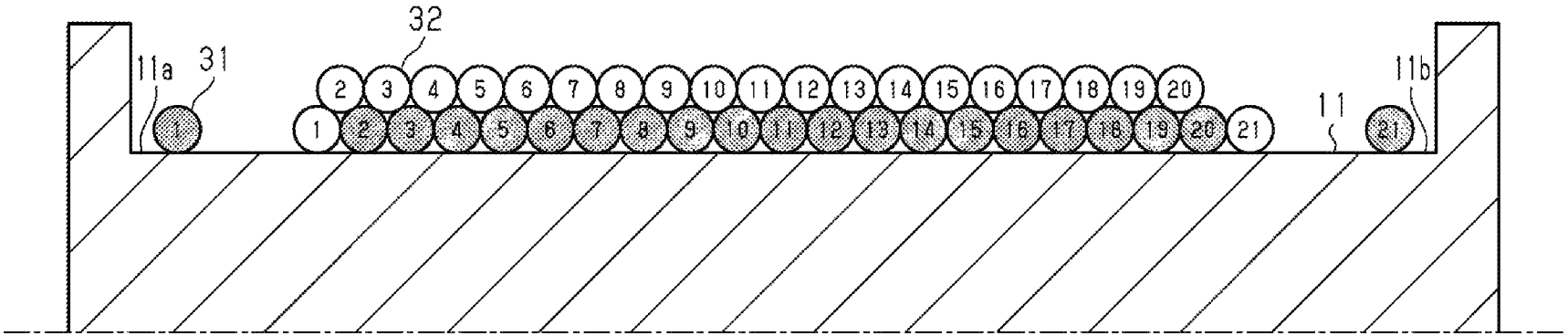

As illustrated in FIG. 7B, the first wire 31 may be wound such that the first turn, which is the first turn, is separated from the subsequent second turn and such that the final twenty-first turn is separated from the preceding twentieth turn. In addition, the second wire 32 is wound so as to contact the first wire 31 from the second turn to the twentieth turn of the first wire 31. The first wire 31 and the second wire 32 can be easily wound by winding the first wire 31 and the second wire 32 in this way. Furthermore, the ways in which the wires are wound on the first end portion 11*a* side and the second end portion 11*b* side of the core part 11 are symmetrical and therefore directionality of the electrical characteristics can be reduced.

Figure 8A:
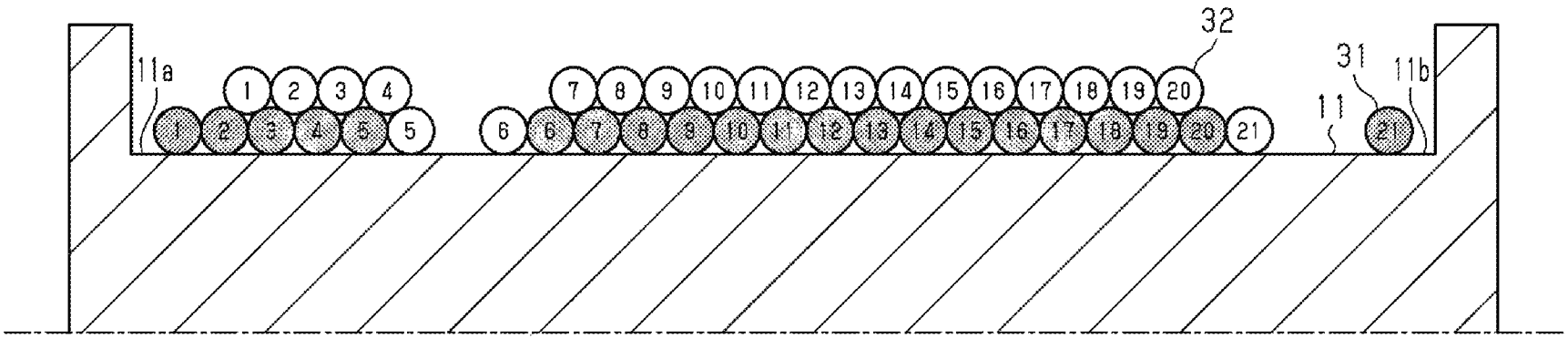
FIGS. 8A and 8B are explanatory diagrams illustrating windings of a coil component of a modification.

As illustrated in FIG. 8A, spaces may be formed at a plurality of places along the first wire 31. In the modification illustrated in FIG. 8A, the first wire 31 is wound such that a space is formed between the fifth turn and the sixth turn and between the twentieth turn and the twenty-first turn. With this configuration, similarly to as in the winding state illustrated in FIG. 7A, a parasitic capacitance generated between different turns of the first wire 31 and the second wire 32 can be reduced by making the first wire 31 and the second wire 32 cross each other between the fifth turn and the sixth turn. In addition, by forming a space between the twentieth turn and twenty-first turn of the first wire 31, the difference between the inductance value L of the first coil and the inductance value L of the second coil formed by the second wire 32 can be reduced and the mode conversion characteristic can be improved.

Figure 8B:
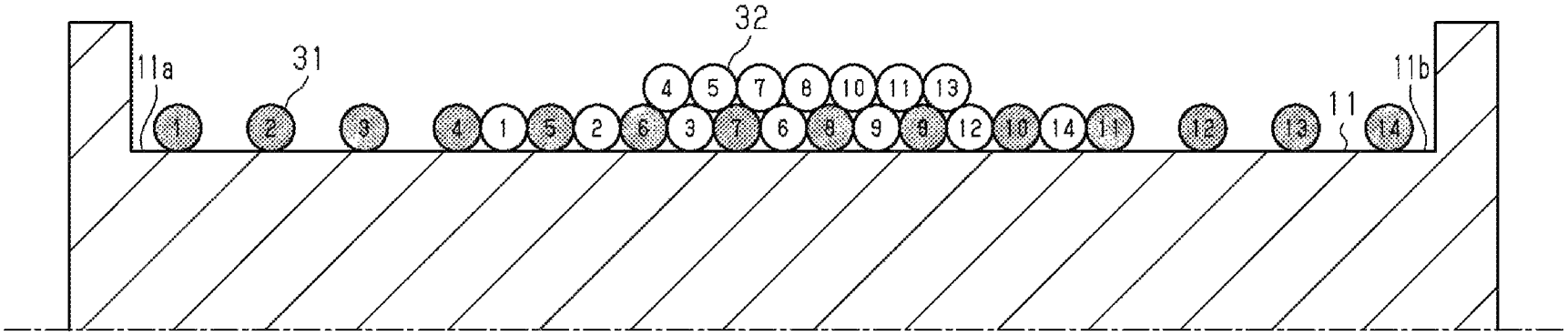

As illustrated in FIG. 8B, the pitch at which turns of the first wire 31 are wound may be increased such that the turns do not contact each other. The pitch can be made uniform between the first turn and the fourteenth turn, for example. The coil length of the first coil formed by the first wire 31 can be easily changed in this way as well.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a core including a core part having a first end portion and a second end portion; and a first wire and a second wire that are wound around the core part from the first end portion to the second end portion in substantially helical shapes so as to have substantially identical numbers of turns;

wherein the first wire is wound so as to form a first layer that contacts a peripheral surface of the core part, the second wire is wound such that at least part of the second wire forms a second layer on the outside of the first layer, a first coil length formed by the first wire is longer than a second coil length formed by the second wire, a first turn of the first wire is wound to be separated from a first turn of the second wire, or a final turn of the first wire is wound to be separated from a final turn of the second wire, and a distance between the first turn of the first wire and the first turn of the second wire, or a distance between the final turn of the first wire and the final turn of the second wire, is longer than a distance between a turn of the first wire and an adjacent different numbered turn of the second wire, except for the first and final turns of the first and second wires.

2. The coil component according to claim 1, wherein in the first wire, there is a turn where a gap is formed by leaving a space between that turn and an adjacent turn of the first wire.

3. The coil component according to claim 1, wherein in a direction from the first end portion to the second end portion of the core part, there is a part in which the first wire is wound such that a gap is not formed between adjacent turns and a part in which the first wire is wound such that a gap is formed between adjacent turns.

4. The coil component according to claim 1, wherein in the first wire, a plurality of parts are provided in which the first wire is wound such that gaps are formed between adjacent turns.

5. The coil component according to claim 1, wherein the first wire is wound such that a gap is formed between at least either of two adjacent turns on the first end portion side and two adjacent turns on the second end portion side.

6. The coil component according to claim 1, wherein the first wire is wound such that a gap is formed between all adjacent turns.

7. The coil component according to claim 6, wherein spaces between the adjacent turns are uniform.

8. The coil component according to claim 2, wherein in a direction from the first end portion to the second end portion of the core part, there is a part in which the first wire is wound such that a gap is not formed between adjacent turns and a part in which the first wire is wound such that a gap is formed between adjacent turns.

9. The coil component according to claim 2, wherein in the first wire, a plurality of parts are provided in which the first wire is wound such that gaps are formed between adjacent turns.

10. The coil component according to claim 2, wherein the first wire is wound such that a gap is formed between at least either of two adjacent turns on the first end portion side and two adjacent turns on the second end portion side.

11. The coil component according to claim 2, wherein the first wire is wound such that a gap is formed between all adjacent turns.

12. The coil component according to claim 11, wherein spaces between the adjacent turns are uniform.

13. The coil component according to claim 1, wherein the final turn of the first wire is wound to be separated from the final turn of the second wire.

14. The coil component according to claim 1, wherein the first turn of the first wire is wound to be separated from the first turn of the second wire.

15. The coil component according to claim 1, wherein a second to the final turn of the first wire and the final turn of the first wire are separated from each other by at least three times a diameter of the first wire.

16. The coil component according to claim 1, wherein the first turn of the second wire is closer to the first end portion than the first turn of the first wire, and the final turn of the first wire is closer to the second end portion than the final turn of the second wire.

17. The coil component according to claim 1, wherein a gap is not formed between the first wire and the second wire except for between the first turn of the first wire and the first turn of the second wire or except for between the final turn of the first wire and the final turn of the second wire.

18. The coil component according to claim 1, wherein the first wire is wound such that a gap is not formed between adjacent turns except for between the first turn of the first wire and a second turn of the first wire or except for a second to final turn of the first wire and the final turn of the first wire.

19. A coil component comprising:

a core including a core part having a first end portion and a second end portion; and a first wire and a second wire that are wound around the core part from the first end portion to the second end portion in substantially helical shapes so as to have substantially identical numbers of turns;

wherein the first wire is wound so as to form a first layer that contacts a peripheral surface of the core part, the second wire is wound such that at least part of the second wire forms a second layer on the outside of the first layer, a first coil length formed by the first wire is longer than a second coil length formed by the second wire, a second to a final turn of the first wire and the final turn of the first wire are separated from each other by at least three times a diameter of the first wire, and a distance between the first turn of the first wire and the first turn of the second wire, or a distance between the final turn of the first wire and the final turn of the second wire, is longer than a distance between a turn of the first wire and an adjacent different numbered turn of the second wire, except for the first and final turns of the first and second wires.

20. The coil component according to claim 19, wherein a gap is not formed between the first wire and the second wire except for between the first turn of the first wire and the first turn of the second wire or except for between the final turn of the first wire and the final turn of the second wire.

21. The coil component according to claim 19, wherein the first wire is wound such that a gap is not formed between adjacent turns except for between the first turn of the first wire and a second turn of the first wire or except for a second to final turn of the first wire and the final turn of the first wire.

* * * * *